US008275271B2

(12) United States Patent
Satonaga et al.

(10) Patent No.: US 8,275,271 B2
(45) Date of Patent: Sep. 25, 2012

(54) IMAGE FORMING APPARATUS, CONSUMABLE ITEM MANAGEMENT SYSTEM AND COMPUTER-READABLE MEDIUM

(75) Inventors: Tetsuichi Satonaga, Ashigarakami-gun (JP); Masayasu Takano, Ebina (JP); Noriyuki Matsuda, Ebina (JP); Akiko Seta, Ebina (JP); Koji Adachi, Ashigarakami-gun (JP); Kaoru Yasukawa, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 443 days.

(21) Appl. No.: 12/544,472

(22) Filed: Aug. 20, 2009

(65) Prior Publication Data

US 2010/0202787 A1 Aug. 12, 2010

(30) Foreign Application Priority Data

Feb. 6, 2009 (JP) ..... 2009-026142

(51) Int. Cl.
*G03G 15/00* (2006.01)

(52) U.S. Cl. ..... 399/24

(58) Field of Classification Search ..... 399/12, 399/24–30

See application file for complete search history.

(56) References Cited

U.S. PATENT DOCUMENTS 6,967,733 B1 * 11/2005 Minowa ..... 399/24
2002/0143893 A1 10/2002 Nakazono et al.
2007/0201883 A1 * 8/2007 Nakazawa et al. ..... 399/12

FOREIGN PATENT DOCUMENTS

JP 2002-287920 A 10/2002

* cited by examiner

*Primary Examiner* — Walter L Lindsay, Jr.
*Assistant Examiner* — Ruth Labombard
(74) *Attorney, Agent, or Firm* — Sughrue Mion, PLLC

(57) ABSTRACT

An image forming apparatus includes a prediction unit, an inquiry unit and a request unit. The inquiry unit judges whether or not the prediction unit deals with a type of a consumable item used in image formation processing. The request unit transmits use history information to a consumable item management apparatus and requests the consumable item management apparatus to predict a remaining usable period of the consumable item when the inquiry unit judges the prediction unit does not deal with the type of the consumable item in the image formation processing. The use history information indicates a use history of the consumable item. The prediction unit predicts the remaining usable period of the consumable item using the use history information in the image formation processing when the inquiry unit judges the first prediction unit deals with the type of the consumable item used in image formation processing.

10 Claims, 5 Drawing Sheets

IMAGE FORMING APPARATUS, CONSUMABLE ITEM MANAGEMENT SYSTEM AND COMPUTER-READABLE MEDIUM

CROSS-REFERENCE TO RELATED APPLICATIONS

This application is based on and claims priority under 35 USC119 from Japanese Patent Application No. 2009-026142 filed Feb. 6, 2009.

BACKGROUND

1. Technical Field

The present invention relates to an image forming apparatus, a consumable item management system and a computer readable medium.

2. Related Art

In image formation processing in an image forming apparatus represented by a printer or the like, print processing is performed by using print materials such as a photoreceptor, a toner, and the like. Because these materials are reduced or degraded according to the use thereof, they are consumable items which require maintenance.

Similarly to the image forming apparatus, with the advancement of technology, these consumable items are also updated to become new products, and the new products normally have upward compatibility. Accordingly, new-type consumable items can be attached to an image forming apparatus to which old-type consumable items are attached so that the image forming apparatus is used with the new-type consumable items attached thereto.

On the other hand, the consumable items require maintenance such as replacement or addition according to their use frequencies, and there is disclosed a technology in which, when the maintenance described above is performed, the replacement of the consumable items is performed without bringing the image forming apparatus into a stop state due to the lack of the consumable items by preliminarily carrying out a prediction of replacement of the consumable items, whereby convenience is enhanced.

SUMMARY

According to an aspect of the invention, an image forming apparatus includes a prediction unit, an inquiry unit and a request unit. The inquiry unit judges whether or not the prediction unit deals with a type of a consumable item used in image formation processing. The request unit transmits use history information to a consumable item management apparatus and requests the consumable item management apparatus to predict a remaining usable period of the consumable item when the inquiry unit judges the prediction unit does not deal with the type of the consumable item in the image formation processing. The use history information indicates a use history of the consumable item. The prediction unit predicts the remaining usable period of the consumable item using the use history information of the consumable item in the image formation processing when the inquiry unit judges the first prediction unit deals with the type of the consumable item used in image formation processing.

BRIEF DESCRIPTION OF THE DRAWINGS

Exemplary embodiment of the invention will be described in detail based on the following figures, wherein.

DETAILED DESCRIPTION

A detailed description will be given herein below to an embodiment of an image forming apparatus, a consumable item management system, and a computer readable medium storing a program causing a computer to execute a processing for management of a consumable item according to the present invention with reference to the accompanying drawings.

Figure 1:
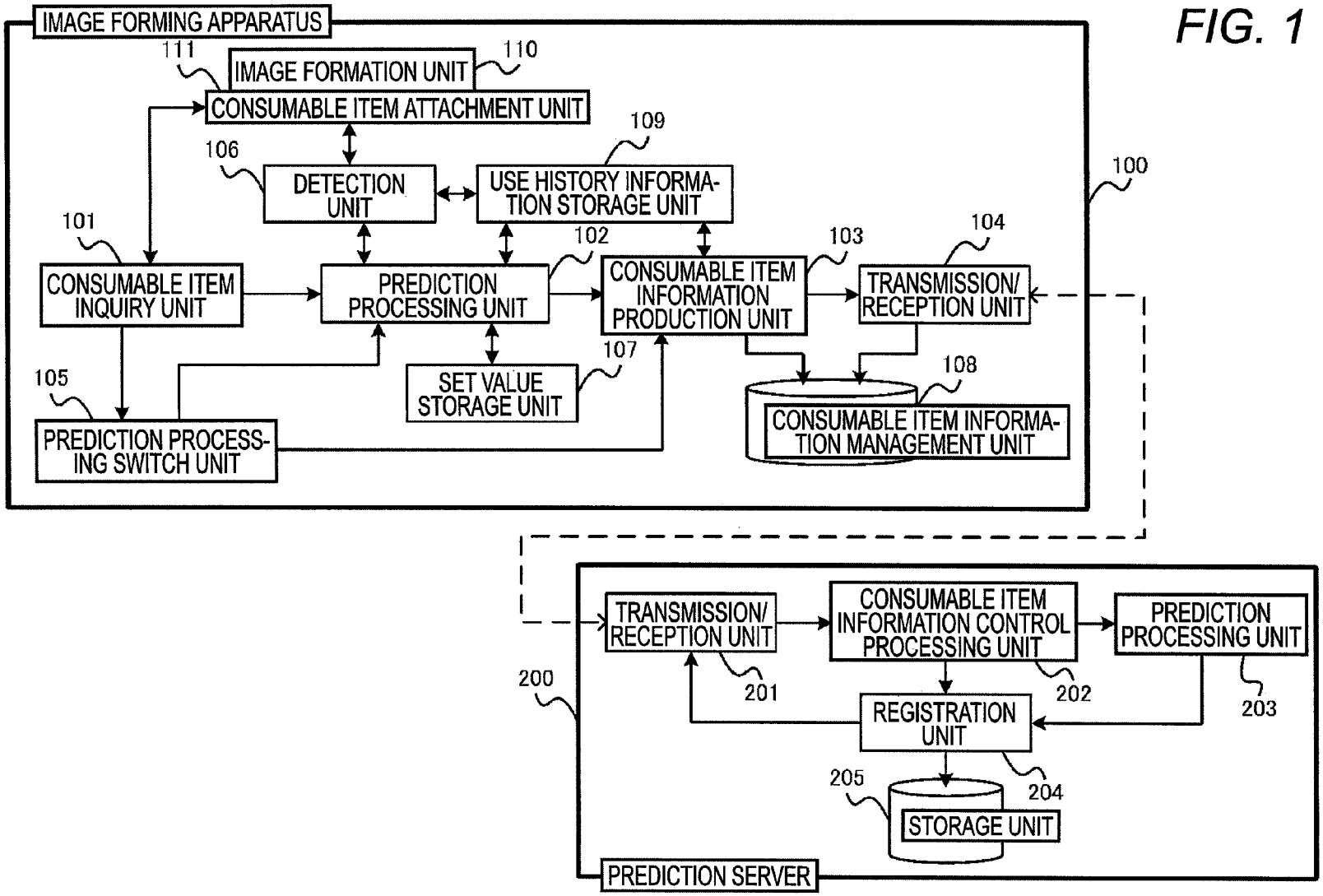
FIG. 1 shows an example of a system structural view of a consumable item management system constituted by applying thereto an image forming apparatus, a consumable item management system, and a computer readable medium storing a program causing a computer to execute a processing for management of a consumable item in an embodiment of the present invention.

In FIG. 1, the consumable item management system includes one or a plurality of image forming apparatus 100 for performing image formation processing of image data and a prediction server 200 (also referred to as "a consumable item management apparatus 200") for predicting, for each consumable item, a remaining usable period of the consumable item (information on a remaining period during which the consumable item can be used, herein below referred to as "a consumable item life") before the consumable item is brought into an unusable state (herein below referred to as "a life end state") by receiving use history information indicative of the use history of the consumable item from the image forming apparatus 100.

The consumable item attached to the image forming apparatus 100 includes, e.g., in addition to a toner and a photoreceptor (a drum) as print materials, a feed roller, a fuser unit, and the like. The life end state indicates a state where use amounts of these consumable items or wear amounts thereof are "0%" or approximate values relative to a total usable amount of "100%".

The consumable item life indicates elapsed time during which the total usable amount of the consumable item decreases from "100%" to "0%" which indicates the life end state.

A state of the total usable amount which is before the state where the consumable item becomes the life end state and it can not be used anymore, and is for avoiding the case where image formation processing is stopped because the consumable item becomes the life end state and it can not be used (herein below referred to as "a life near state") is set. And a manager of the image forming apparatus 100 is prompted to replace the consumable item when the image forming apparatus 100 becomes the life near state.

The use amount or the wear amount of each consumable item is detected by using a sensor, a counter, or the like provided in the consumable item.

The image forming apparatus 100 records the use amount or the like detected by the sensor or the like in correspondence to a processing condition in the image formation processing as use history information, and performs prediction of the consumable item life for each consumable item. The prediction processing of the consumable item life in the image forming apparatus 100 determines whether or not, in correspondence between information indicative of a type of a consumable item set in the consumable item and a type in "a consumable item life prediction mechanism", the type of the consumable item corresponds to the type in the consumable item life prediction mechanism.

The consumable item life prediction mechanism is implemented by, e.g., prediction program of firmware or the like, and performs prediction processing of the consumable item life with regard to the consumable item with the type with which the prediction program deals.

When the type of the consumable item is the type corresponding to the type in the consumable item life prediction mechanism, the consumable item life prediction mechanism executes the prediction processing of the consumable item life. On the other hand, when the type of the consumable item is not the type with which the consumable item life prediction mechanism deals, the consumable item life prediction mechanism transmits recorded use history information to the prediction server 200, and makes a request for prediction processing.

The image forming apparatus 100 includes a consumable item inquiry unit 101, a prediction processing unit 102, a consumable item information production unit 103, a transmission/reception unit 104, a prediction processing switch unit 105, a detection unit 106, a set value storage unit 107, a consumable item information management unit 108, a use history information storage unit 109, an image formation unit 110, and a consumable item attachment unit 111.

In the image formation unit 110, image formation processing is performed by using the consumable item attached to the consumable item attachment unit 111. When the image formation processing is performed in the image formation unit 110, the detection unit 106 constituted by the sensor, the counter, or the like detects the use amount, the wear amount, and the like of the consumable item in the image formation processing, records them in correspondence to processing conditions of the image formation processing, and stores them in the use history information storage unit 109.

In the use history information storage unit 109, the use amount or the like which corresponds to the processing condition and is detected by the sensor or the like is stored as the use history information.

The processing condition in the image formation processing includes the number of printed sheets, the number of printed pages per unit number of sheets, monochrome/color, single side/both sides, and the like, and the use amount or the wear amount of the consumable item used in the image formation processing based on the processing conditions is detected in the detection unit 106.

When the image formation processing or the like is performed by the image formation unit 110 and, as a result, the request for prediction of the consumable item is made, the consumable item inquiry unit 101 acquires the type of the consumable item used when the image formation unit 110 performs the image formation processing from the consumable item attachment unit 111, and inquires whether or not the type of the consumable item corresponds to the type in the consumable item life prediction mechanism. For example, when the consumable item life prediction mechanism is implemented by the firmware, it is inquired whether or not the consumable item corresponds thereto using a combination of a version of the firmware and the type of the consumable item.

The inquiry about the consumable item is performed in the consumable item inquiry unit 101 and, when it is determined that the consumable item is the one with which the consumable item life prediction mechanism of the image forming apparatus 100 deals by the inquiry, the consumable item inquiry unit 101 notifies the prediction processing unit 102 of the result of the inquiry. That is, it is indicated that the consumable item is the one of which the consumable item life prediction mechanism can perform the prediction processing of the consumable item life.

The meaning of the wording "the consumable item life prediction mechanism (the prediction processing unit 102) deals with the type of the consumable item" used herein may not be limited to that the consumable item life prediction mechanism can predict the consumable item life of the consumable item of the type, and the wording may mean that the consumable item life prediction mechanism can predict the consumable item life in correspondence to (applicable to) the type.

That is, when the consumable item life of a new-type consumable item is predicted, although the consumable item life can be predicted by using the prediction method for an old-type consumable item (which the prediction processing unit 102 can carry out), because properties of the new-type consumable item are not considered in the prediction method for the old-type consumable item, there is a case where the consumable item life is predicted to be shorter than necessary.

In this case, since the prediction processing unit 102 does not predict the consumable item life in correspondence to the type, it may be defined that the consumable item life prediction mechanism (the prediction processing unit 102) does not deal with the type of the consumable item.

On receiving the notification, the prediction processing unit 102 makes a request for detection of the use mount or the wear amount of the consumable item to the detection unit 106 and, further, makes a request for acquisition of the use history information of each consumable item to the use history information storage unit 109.

The prediction processing unit 102 performs processing for predicting the consumable item life based on the use history information of each consumable item acquired from the use history information storage unit 109 in response to the request for acquisition and the use amount or the wear amount of the consumable item received from the detection unit 106. In the prediction processing in the prediction processing unit 102, it is also possible to add the processing conditions in the image formation processing in the image formation unit 110 to conditions in the prediction processing.

Figure 5:
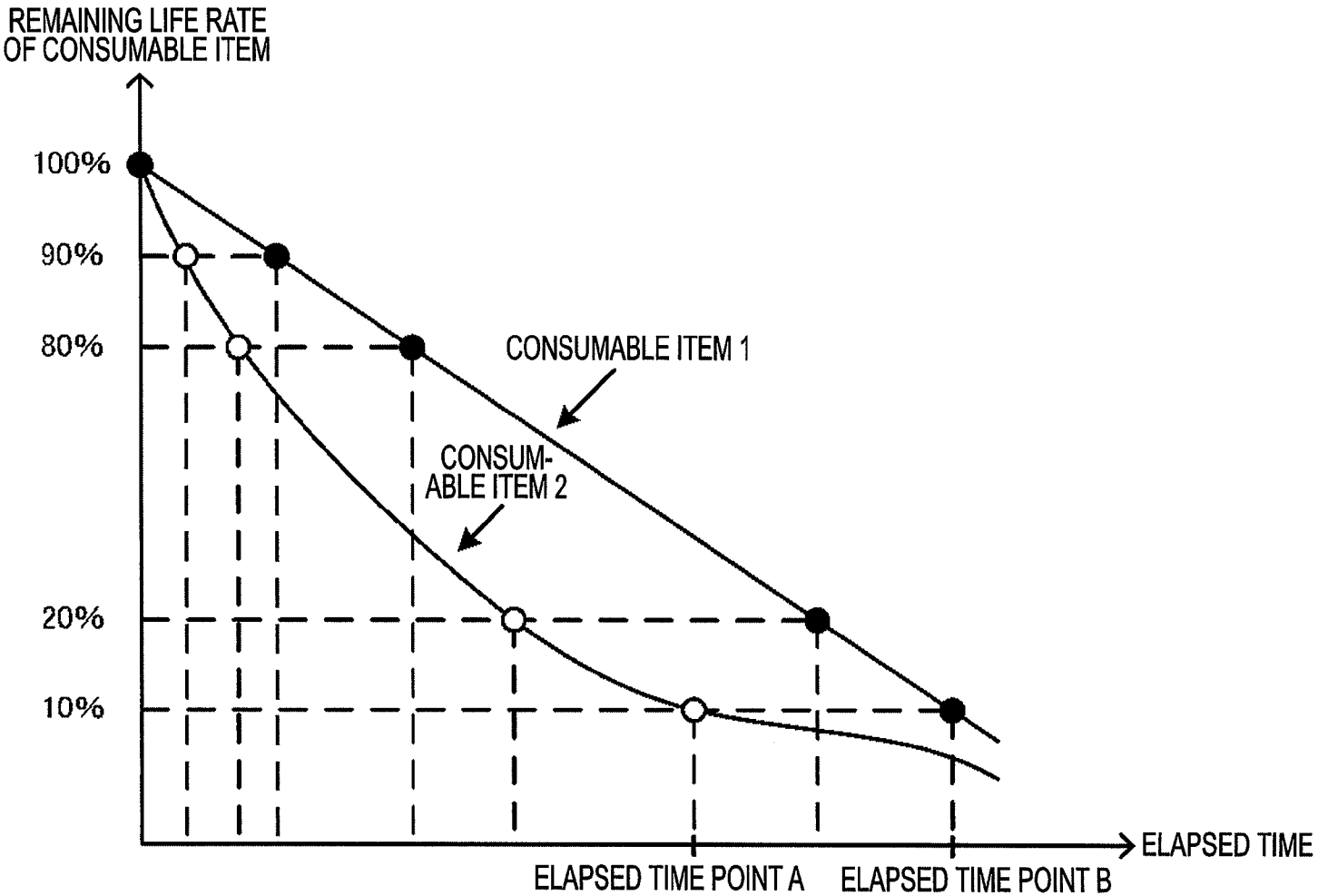
FIG. 5 is a view showing a consumption state of each consumable item.

FIG. 5 is a view showing a consumption state of each consumable item used in the prediction processing of the prediction processing unit 102 in which the horizontal axis indicates elapsed time, while the vertical axis indicates a remaining life rate of the consumable item.

FIG. 5 shows consumption states of two consumable items which are "a consumable item 1" and "a consumable item 2", and the line indicative of the consumption state of the consumable item 1 shows a moderate consumption state as a whole when compared with the line indicative of the consumption state of the consumable item 2.

When the remaining life rate of the consumable item indicative of the life near state is "10%", the line indicative of the consumable item 1 shows that the consumable item 1 becomes the life near state at "an elapsed time point B", while the line indicative of the consumable item 2 shows that the consumable item 2 becomes the life near state at "the elapsed time point A". In this case, since it is shown that the elapsed time at "the elapsed time point B" is longer than the elapsed time at "the elapsed time point A", it is shown that the progress of the consumption state of "the consumable item 2" is faster than the progress of the consumption state of "the consumable item 1".

As shown in FIG. 5, the prediction processing unit 102 predicts the consumable item life by prediction of use subsequent to the present time using the use history information indicative of the use history of the consumable item in the past and the use amount of the consumable item in the image formation processing. Further, the prediction processing unit 102 also predicts the elapsed time point where the consumable item becomes the life near state.

In the example shown in FIG. 5, it is predicted that "the elapsed time point B" is the elapsed time point where "the consumable item 1" becomes the life near state, while "the elapsed time point A" is the elapsed time point where "the consumable item 2" becomes the life near point.

The remaining life rate of the consumable item when the consumable item is determined to be in the life near state in the prediction processing unit 102 is acquired from the set value storage unit 107. The set value storage unit 107 stores the remaining life rate with which the life near state is determined for each consumable item. For example, in a case where a toner is the consumable item, when the remaining amount of the toner is "10%", the set value storage unit 107 stores the value as the remaining life rate indicative of the life near state and, in a case where a feed roller is the consumable item, when the number of rotations thereof reaches 20000, the set value storage unit 107 stores the value as the remaining life rate indicative of the life near state.

When the prediction processing of the consumable item life is performed by the prediction processing unit 102, the prediction processing unit 102 sends the result of the prediction processing to the consumable item information production unit 103 and makes a request for production of consumable item information. When the result of the prediction processing received from the prediction processing unit 102 indicates that the consumable item is in the life near state where the replacement of the consumable item is required, the consumable item information production unit 103 produces the consumable item information indicating that the corresponding consumable item is in the life near state.

The consumable item information produced in the consumable item information production unit 103 includes at least a consumable item ID for identifying the consumable item in the life near state and information indicating that the consumable item is in the life near state, and stores the produced consumable item information in the consumable item information management unit 108.

Thus, when it is determined that the type of the consumable item and the type in the consumable item life prediction mechanism correspond to each other by the consumable item inquiry unit 101, the prediction processing of the consumable item life is performed in the image forming apparatus 100.

On the other hand, when it is determined that the type of the consumable item and the type in the consumable item life prediction mechanism do not correspond to each other by the consumable item inquiry unit 101, the decision is notified to the prediction processing switch unit 105. The prediction processing switch unit 105 performs processing for switching the executer of the prediction processing of the consumable item life to the prediction server 200.

In the prediction processing switch unit 105, the switching is performed by disabling the prediction processing in the prediction processing unit 102 of the image forming apparatus 100.

When the switch processing is performed in the prediction processing switch unit 105, the prediction processing switch unit 105 notifies the consumable item information production unit 103 that the switching processing has been performed. When notified that the switching processing has been performed from the prediction processing switch unit 105, the consumable item information production unit 103 acquires the use history information of each consumable item stored in the use history information storage unit 109.

The acquired use history information also includes the use history information of the consumable item used in the image formation processing in the image formation unit 110 of which the request for prediction is made to the consumable item inquiry unit 101.

The consumable item information production unit 103 produces the consumable item information including the acquired use history information, the type of the consumable item, and the consumable item ID, sends the consumable item information to the transmission/reception unit 104, and stores the consumable item information in the consumable item information management unit 108. On receiving the consumable item information produced by the consumable item information production unit 103, the transmission/reception unit 104 transmits the consumable item information to the prediction server 200 and makes the request for prediction.

Thus, when it is not determined that the type of the consumable item and the type in the consumable item life prediction mechanism correspond to each other by the consumable item inquiry unit 101, the request for prediction is made to the prediction server 200.

The consumable item management server 200 includes a transmission/reception unit 201, a consumable item information control processing unit 202, a prediction processing unit 203, a registration unit 204, and a storage unit 205, and receives the consumable item information from the image forming apparatus 100 via the transmission/reception unit 201.

On receiving the consumable item information, the transmission/reception unit 201 sends the consumable item information to the consumable item information control processing unit 202. On confirming that the consumable item information is received from the image forming apparatus 100, the consumable item information control processing unit 202 makes the request for prediction by sending the consumable item information to the prediction processing unit 203. In addition, the consumable item information control processing unit 202 transmits the received consumable item information to the registration unit 204.

In the prediction processing unit 203 to which the consumable item information is sent and the request for prediction is made by the consumable item information control processing unit 202, the prediction processing of the consumable item life is performed based on the consumable item information. In the same manner as in the prediction processing in the image forming apparatus 100 described above, the consumption state of each consumable item is graphed as shown in FIG. 5 and the remaining life rate of the consumable item indicative of the life near state, for example, the elapsed time point having the remaining life rate of "10%" is predicted.

The prediction processing unit 203 deals with more types of the consumable items than the prediction processing unit 102 of the image forming apparatus 100 (for example, when a new-type consumable item is developed after the image forming apparatus 100 is shipped, the prediction processing unit 102 of the image forming apparatus 100 can not deal with the new-type consumable item).

That is, in the case shown in FIG. 5, it is shown that the consumable item 1 becomes the life near state at "the elapsed time point B", and the consumable item 2 becomes the life near state at "the elapsed time point A". In this case, since it is shown that the elapsed time at "the elapsed time point B" is longer than the elapsed time at "the elapsed time point A", it is shown that the progress of the consumption state of "the consumable item 2" is faster than the progress of the consumption state of "the consumable item 1".

As shown in FIG. 5, the prediction processing unit 203 predicts the consumable item life by prediction of use subsequent to the present time using the use history information indicative of the use history of the consumable item in the past and the use amount of the consumable item in the image formation processing. Further, the prediction processing unit 203 also predicts the elapsed time point where the consumable item becomes the life near state.

In the example shown in FIG. 5, "the elapsed time point B" is the elapsed time point where "the consumable item 1" becomes the life near state, while "the elapsed time point A" is the elapsed time point where "the consumable item 2" becomes the life near point.

Thus, when the prediction processing of the consumable item life is performed, the prediction result is sent to the transmission/reception unit 201 in order to transmit the prediction result to the image forming apparatus 100 as the transmission source of the consumable item information, and is further sent to the registration unit 204.

At this time, the transmission/reception unit 201 transmits information on the prediction result to the image forming apparatus as the transmission source of the consumable item information, and the registration unit 204 stores the consumable item information and the prediction result based on the consumable item information in correspondence to each other in the storage unit 205.

The prediction processing unit 203 may be structured so as to perform the prediction processing by using the consumable item information and the information on the prediction result in the past stored in the storage unit 205.

At this time, the prediction result of the consumable item life is transmitted from the transmission/reception unit 201, and the image forming apparatus 100 receives the prediction result via the transmission/reception unit 104 and registers the prediction result in the consumable item information management unit 108.

Figure 2:
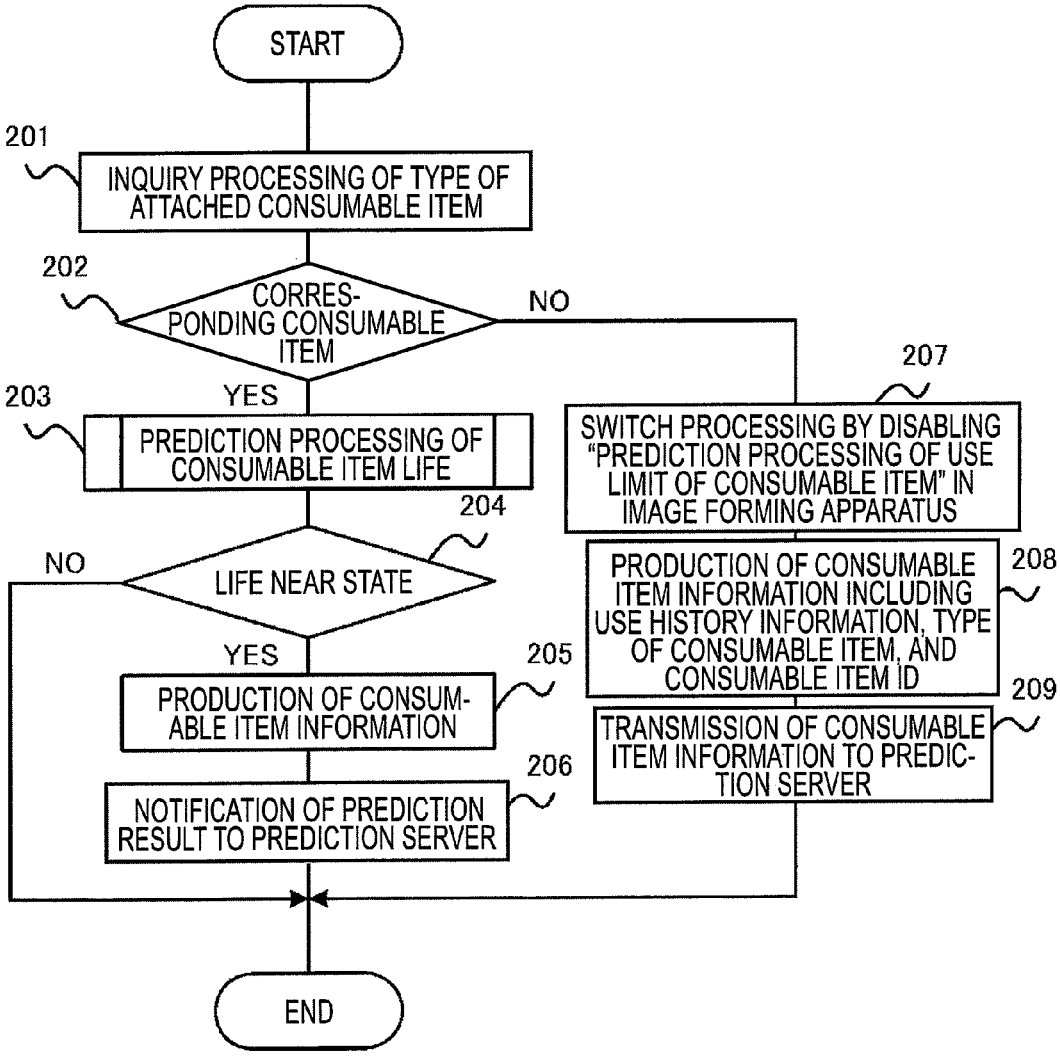
FIG. 2 is a flow chart illustrating a detailed flow of processing performed in the image forming apparatus constituting the consumable item management system in the embodiment of the present invention.

FIG. 2 is a flow chart illustrating the detailed flow of the processing performed in the image forming apparatus constituting the consumable item management system in the embodiment of the present invention.

In the flow chart shown in FIG. 2, the processing is performed for each of consumable items attached to the image forming apparatus, and the processing is therefore performed the number of times equal to the number of attached consumable items.

In FIG. 2, the image forming apparatus starts the processing when the image formation processing or the like is performed and, as a result, the request for prediction of the consumable item is made, and performs inquiry processing for inquiring whether or not the type of the consumable item attached to the image forming apparatus corresponds to the type in the consumable item life prediction mechanism (201).

According to the result of the inquiry processing, it is determined whether or not the corresponding consumable item is attached (202). When the corresponding consumable item is attached (YES in 202), the prediction processing of the consumable item life is performed (203). The detailed flow of the prediction processing of the consumable item life is shown in the flow chart of FIG. 3 and will be described herein below.

When the prediction processing of the consumable item life is performed, subsequently, according to the result of the prediction processing, it is determined whether or not the consumable item is in the life near state (204). When it is determined that the consumable item is in the life near state (YES in 204), the consumable item information including at least the consumable item ID for identifying the consumable item in the life near state and the information indicating that the consumable item is in the life near state is produced (205).

Further, the prediction result is transmitted to the prediction server (206).

On the other hand, when it is determined that the type of the consumable item attach to the image forming apparatus does not correspond to the type in the consumable item life prediction mechanism (NO in 202), the switch processing for switching the prediction processing is performed by disabling the prediction processing function in the image forming apparatus (207). When the prediction in the prediction server is specified by the switching of the prediction processing, the consumable item information including the use history information, the type of the consumable item, and the consumable item ID is produced (208), and the consumable item information is transmitted to the prediction server (209).

Figure 3:
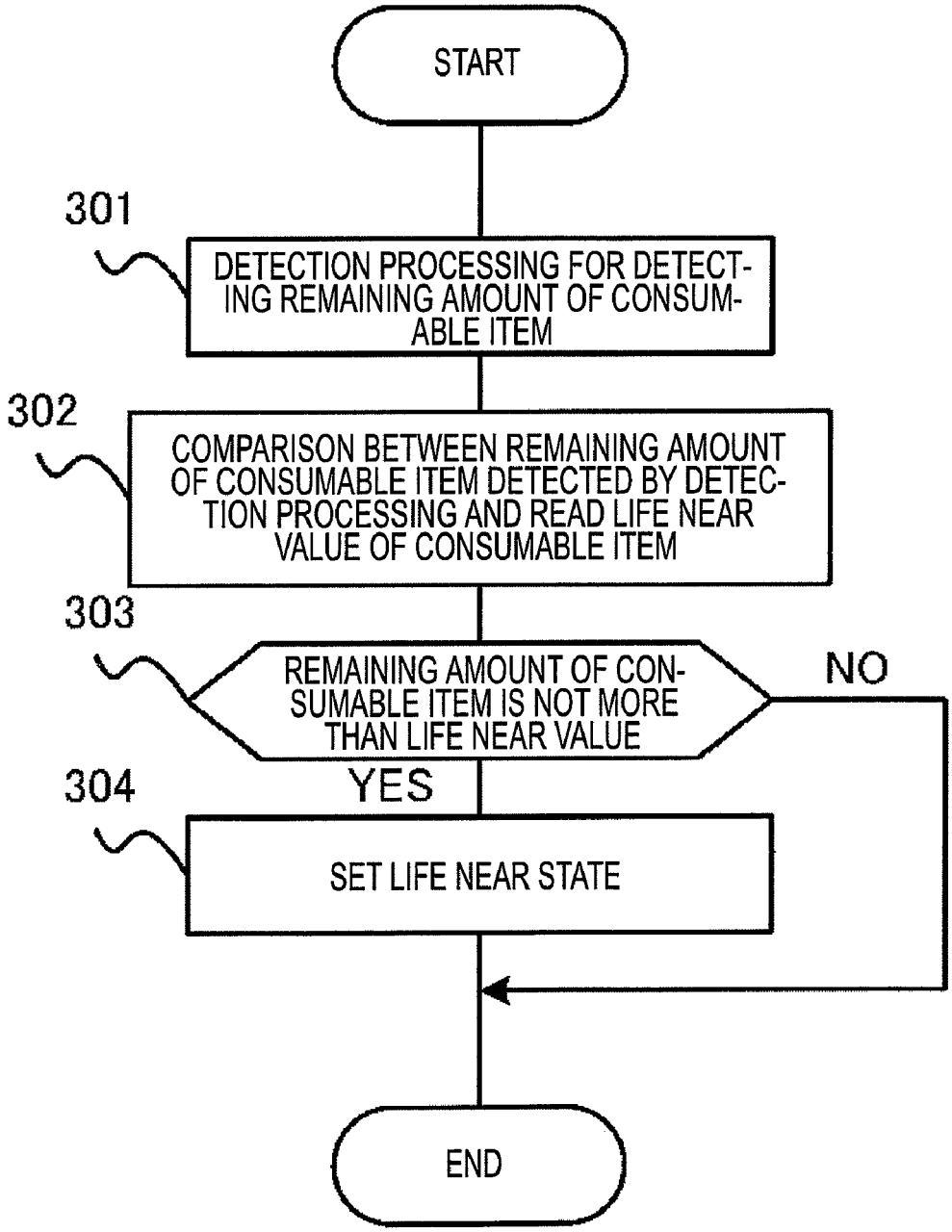
FIG. 3 is a flow chart illustrating a detailed flow in prediction processing of a consumable item life shown in FIG. 2.

FIG. 3 is a flow chart illustrating the detailed flow in the prediction processing of the consumable item life shown in FIG. 2.

In the flow chart in FIG. 3, processing is started when it is determined that the type of the consumable item attached to the image forming apparatus corresponds to the type in the consumable item life prediction mechanism, and detection processing for detecting the remaining amount of the consumable item is performed using a sensor, a counter, or the like (301).

When the remaining amount of the consumable item is detected by the detection processing, it is determined whether or not the remaining amount of the consumable item is not more than a read value of the remaining life rate of the consumable item with which the consumable item is determined to be in the life near state (a life near value) (302).

As the result, it is determined whether or not the remaining amount of the consumable item is not more than the life near value (303) and, when the remaining amount is not more than the life near value (YES in 303), the image forming apparatus is set to be in the life near state (304).

Figure 4:
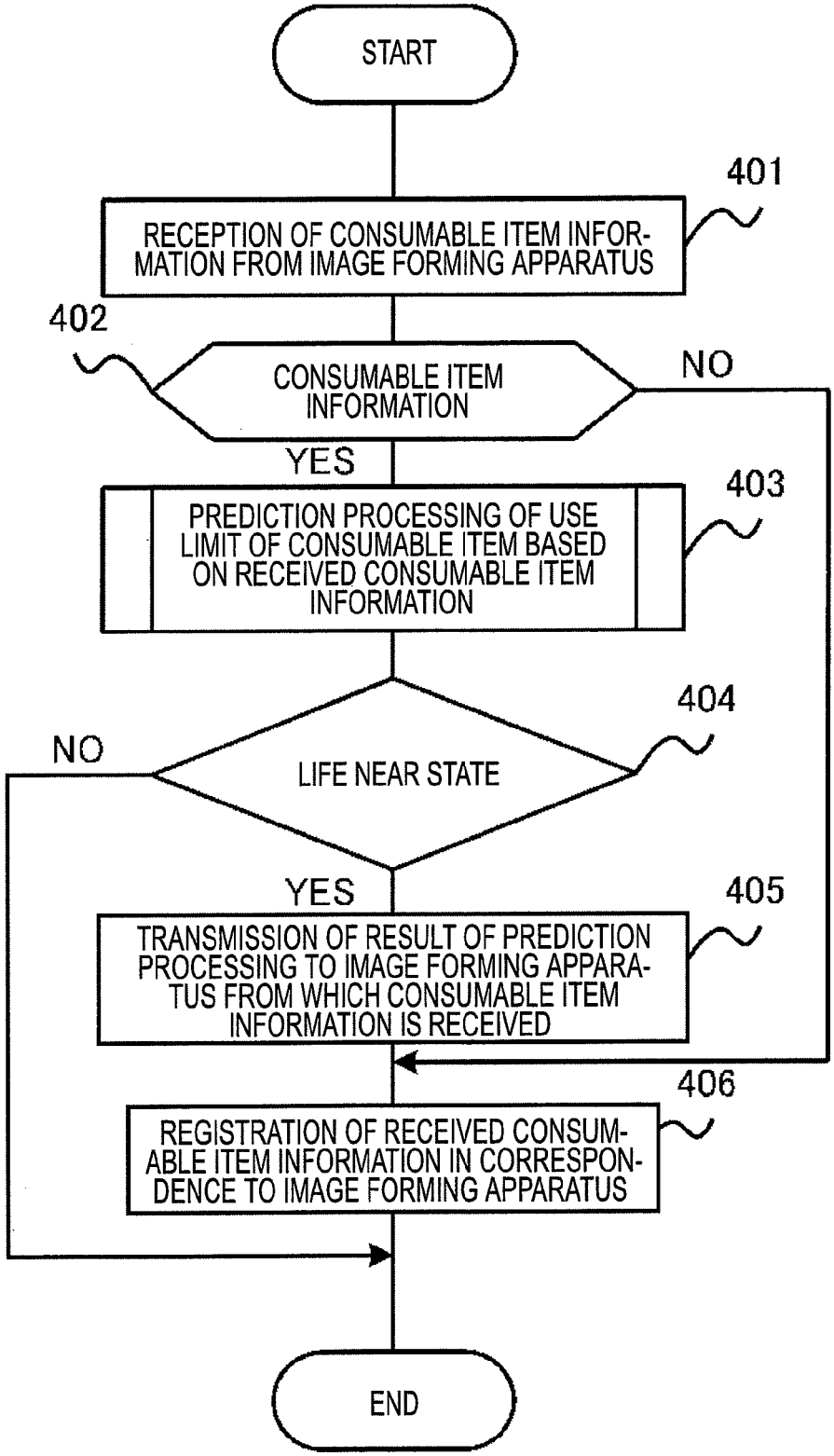
FIG. 4 is a flow chart illustrating a flow of processing performed in a prediction server constituting the consumable item management system in the embodiment of the present invention.

FIG. 4 is a flow chart illustrating the flow of the processing performed in the prediction server constituting the consumable item management system in the embodiment of the present invention.

In FIG. 4, on receiving predetermined information from the image forming apparatus (401), the prediction server determines whether or not the received information is the consumable item information (402). When the prediction server determines that the consumable item information is received (YES in 402), the prediction server performs the prediction processing shown in FIG. 3 (403).

When the prediction server performs the prediction processing, subsequently, according to the result of the prediction processing, the prediction server determines whether or not the image forming apparatus is in the life near state (404) and, when the prediction server determines that the image forming apparatus is in the life near state (YES in 404), the prediction server transmits the prediction result of the consumable item life to the image forming apparatus (405). Then, the prediction server registers the prediction result in correspondence to the received consumable item information (406).

When it is determined that the information received in the prediction server is not the consumable item information (NO in 402), in a case where the information is, e.g., the prediction result of the consumable item life in the image forming apparatus, the prediction server registers the prediction result (406).

In the present invention, it is also possible to constitute the consumable item management system for executing the above-described processing by causing the consumable item management system having communication functions to execute the above-described operations, or by installing, from a recording medium (CD-ROM, DVD-ROM, or the like) storing therein a program for constituting the above-described means, the program in a computer and causing the computer to execute the program. To the computer constituting the consumable item management system, a CPU (Central Processor Unit), a ROM (Read Only Memory), a RAM (Random Access Memory), and a hard disk are connected via a system bus. The CPU performs the processing in accordance with the program stored in the ROM or the hard disk using the RAM as a working area.

The medium for supplying the program may be a communication medium (a medium for temporarily or fluidly holding a program such as a communication line and a communication system). For example, the program may be placed on an electronic bulletin board using a bulletin board service (BBS) in a communication network and the program may be distributed via the communication line.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus performing image formation processing, the image forming apparatus comprising:

a prediction unit;

an inquiry unit that determines whether or not the prediction unit is configured to predict a remaining usable period of a consumable item used in the image formation processing; and a request unit that, if the inquiry unit determines that the prediction unit is not configured to predict the remaining usable period of the consumable item, transmits use history information of the consumable item over a network to a consumable item management apparatus and requests the consumable item management apparatus to predict the remaining usable period of the consumable item.

2. The image forming apparatus of claim 1, wherein if the inquiry unit determines that the prediction unit is configured to predict the remaining usable period of the consumable item, the prediction unit predicts the remaining usable period of the consumable item using the use history information of the consumable item and transmits the remaining usable period predicted by the prediction unit over the network to the consumable item management apparatus.

3. The image forming apparatus of claim 2, wherein the consumable item is a photosensitive drum.

4. A consumable item management system, comprising:

an image forming apparatus that performs image formation processing using a consumable item; and a consumable item management apparatus that manages a remaining usable period based on a type of the consumable item, wherein the image forming apparatus comprises:

a first prediction unit;

an inquiry unit that determines whether or not the first prediction unit is configured to predict a remaining usable period of a consumable item used in the image formation processing; and a first transmission unit that, if the inquiry unit determines that the first prediction unit is not configured to predict the remaining usable period of the consumable item, transmits use history information of the consumable item to the consumable item management apparatus and requests the consumable item management apparatus to predict the remaining usable period of the consumable item; and wherein the consumable item management apparatus comprises:

a reception unit that receives the use history information transmitted by the first transmission unit; and a second prediction unit that predicts the remaining usable period of the consumable item using the use history information received by the reception unit, and a second transmission unit that transmits the remaining usable period of the consumable item predicted by the second prediction unit to the image forming apparatus.

5. The consumable item management system of claim 4, wherein the consumable item is a photosensitive drum.

6. The consumable item management system of claim 4, wherein if the inquiry unit determines that the first prediction unit is configured to predict the remaining usable period of the consumable item using the use history information of the consumable item, the first prediction unit predicts the remaining usable period of the consumable item and transmits the remaining usable period calculated by the first prediction unit over the network to the consumable item management apparatus and the consumable item management apparatus stores in a storage unit the remaining usable period predicted by the first prediction unit and the remaining usable period of the consumable item predicted by the second prediction unit in association with information concerning the consumable item.

7. The consumable item management system of claim 6, wherein the second prediction unit predicts the remaining usable period of the consumable item using the use history information received by the reception unit and prior prediction results stored in the storage unit.

8. A non-transitory computer readable medium storing a program that when executed causes an image forming apparatus to perform a process for managing a consumable item used in image formation processing, the process comprising:

determining whether or not a prediction unit in the image forming apparatus is configured to predict a remaining usable period of the consumable item;

in response to determining that the prediction unit is not configured to predict the remaining usable period of the consumable item, transmitting use history information of the consumable item and a request to predict the remaining usable period of the consumable item over a network to a consumable item management apparatus; and receiving from the consumable item management apparatus, in response to the request and the use history information, the predicted remaining usable period of the consumable item.

9. The non-transitory computer readable medium of claim 8, wherein in response to determining that the prediction unit is configured to predict the remaining usable period of the consumable item, causing a prediction unit within the image processing apparatus to predict the remaining usable period of the consumable item using the use history information of the consumable item and transmits the remaining usable period predicted by the prediction unit over the network to the consumable item management apparatus.

10. The consumable item management system of claim 9, wherein the consumable item is a photosensitive drum.

* * * * *